US005694957A

United States Patent [19]

Lee, Jr.

[11] Patent Number: 5,694,957

[45] Date of Patent: Dec. 9, 1997

[54] SPA CLEANER

[76] Inventor: Fred D. Lee, Jr., 1012 E. Anderson St., Pensacola, Fla. 32503

[21] Appl. No.: 503,159

[22] Filed: Jul. 17, 1995

[51] Int. Cl.[6] ..... B08B 9/02

[52] U.S. Cl. ..... 134/169 C; 134/169 R; 134/166 C; 134/166 R; 4/490

[58] Field of Search ..... 134/166 R, 167 R, 134/168 R, 168 C, 167 C, 169 C, 166 C, 104.1, 171; 4/490, 541.1, 662

[56] References Cited

U.S. PATENT DOCUMENTS

| | | | |
|---|---|---|---|
| 3,431,145 | 3/1969 | Riley | 134/166 R |
| 3,921,652 | 11/1975 | Schmid | 134/171 |
| 4,086,930 | 5/1978 | Hiss | 134/169 A |
| 4,176,708 | 12/1979 | Joffe | 134/169 A |
| 4,383,341 | 5/1983 | Altman | 134/167 R |
| 4,856,125 | 8/1989 | Dijhuizen | 4/543 |
| 4,907,610 | 3/1990 | Meincke | 4/490 |
| 4,919,160 | 4/1990 | Pierce | 134/100 |
| 4,979,245 | 12/1990 | Gardini | 4/542 |
| 4,995,123 | 2/1991 | Kern | 4/490 |
| 5,025,818 | 6/1991 | Kalar | 134/171 |
| 5,090,458 | 2/1992 | Creeron | 134/169 A |
| 5,109,880 | 5/1992 | Booth | 134/108 |
| 5,392,471 | 2/1995 | Vos | 4/490 |

OTHER PUBLICATIONS

EPO 155,502 Gunter 4/490, Sep. 1995.

*Primary Examiner*—Frankie L. Stinson
*Attorney, Agent, or Firm*—Peter Loffler

[57] ABSTRACT

A cleaning system for cleaning the interior pump and piping system of a whirlpool spa is disclosed. The device comprises a compartmentalized tank having an intake chamber and an outlet chamber. The outlet chamber is placed into fluid communication with the spa's suction intake fitting. The intake chamber is placed into fluid communication with the spa's jet openings. Cleaning fluid is introduced into the outlet chamber and cycles from the outlet chamber, through the spa's pumps and pipes, through the spa's jet openings, into the intake chamber, and back into the outlet chamber, which is in fluid communication with the intake chamber. From there, the fluid begins the cycle again. A pair of cooperating valve assemblies block fluid communication between the intake chamber and the outlet chamber and force the cleaning fluid out of the device upon the completion of the cleaning operation.

11 Claims, 11 Drawing Sheets 34
102
32
26
28
100
40
42
122
118
120
92
94
90
86
128
126
64
70
76
78
72
18
24
22
74

24
18
16
28
30
11
11
38
10
68
30
66
66
12,13
50
12,13
62
58
10
54
10
46
44
64
60
9
14
9
98
96
96
100
120
12
130

SPA CLEANER

BACKGROUND OF THE INVENTION

1. Field of the Invention

The present invention relates to a spa cleaner that facilitates the progression of cleaning solution through the internal pipes, hoses, and pumps of a whirlpool spa.

2. Background of the Prior Art

Many contaminants can enter a typical whirlpool. These contaminants may include sun tan oils, hair gels, makeup, etc. Other items introduced into a whirlpool include disinfectants and other solutions added to the whirlpool water. The contaminants and solutions not only contact the tub surface of the whirlpool, but also enter the internal piping and pump system of the whirlpool.

Removal of these items from the tub surface is relatively straightforward. Many devices have been disclosed to assist in the process. Alternatively, a bucket and scrub brush can be employed to effect the cleaning in the old-fashioned way.

However, these contaminants must also be removed from the piping and pump systems on a regular basis. Such cleaning involves removal of the tub water and running an appropriate solution through the piping system. Several devices have been disclosed in order to facilitate running the selected solution through the internal pipes and pump system in order to flush the contaminants and other items from these internal systems. Exemplary of such devices are those disclosed in U.S. Pat. No. 4,856,125 issued to Dijkhuizen and U.S. Pat. No. 5,109,880 issued to Booth.

Such systems generally consist of a pumping system and a circulation system. Although such systems appear to accomplish their intended purpose of cleaning and disinfecting the internal circulation system, these devices have their drawbacks. In order to circulate the intended cleaning solution through the internal components of a whirlpool, these devices rely on a pump. The pump not only increases the size, cost, and complexity of these cleaning devices, such a device is also dependent on an external power source.

Therefore, there is a need in the art for a device for cleaning and disinfecting the internal components of a whirlpool spa that does not rely on a pump attached to the device nor on an external power source in order to operate the device. Such a device should be relatively simple and straightforward to manufacture and use.

SUMMARY OF THE INVENTION

The device of the present invention meets the above-stated needs in the art. The present invention dispels with the need for a pump for device operation, relying instead, upon the pumping system of the whirlpool for cleaning solution circulation. The device does not rely on an external power source for operation The device comprises a dual-chambered tank assembly having an intake chamber and an outlet chamber. The outlet chamber is in fluid communication with the suction intake fitting of the whirlpool. A hose is fitted to each jet of the whirlpool and the inlet chamber acts as a collection manifold for the hoses. A valve assembly controls fluid communication between the intake chamber and the outlet chamber as well as between the intake chamber and a drain assembly.

The device is positioned inside the tub of the whirlpool and the appropriate hoses are attached to the whirlpool's suction intake fitting as well as to the jets. A telescoping compression rod assembly holds the device securely in place. Selected solution is entered into the outlet chamber via a fill assembly. Thereafter, the whirlpool's pumping system is activated and the system draws the solution out of the outlet chamber, circulates it through the whirlpool's internal piping system, and discharges the solution through the jets. The hoses attached to the jets capture the solution and channel it to the intake chamber where it is pressure-forced back to the outlet chamber to begin the cycle again. Once the cleaning process is complete, the valve assembly is adjusted so that the valve between the intake chamber and the outlet chamber is closed. This simultaneously opens a valve located within the drain assembly, allowing the solution to exit the device.

Therefore it is an object of the present invention to provide a whirlpool cleaning device that does not contain a pump.

It is another object of the present invention to provide a whirlpool cleaning device that does not rely on an external power source for proper operation.

It is a final object of the present invention to provide a whirlpool cleaning device that is inexpensive to manufacture and is easy to use.

BRIEF DESCRIPTION OF THE DRAWINGS

Similar reference numerals refer to similar parts throughout the several views of the drawings.

DETAILED DESCRIPTION OF THE PREFERRED EMBODIMENT

Figure 1:
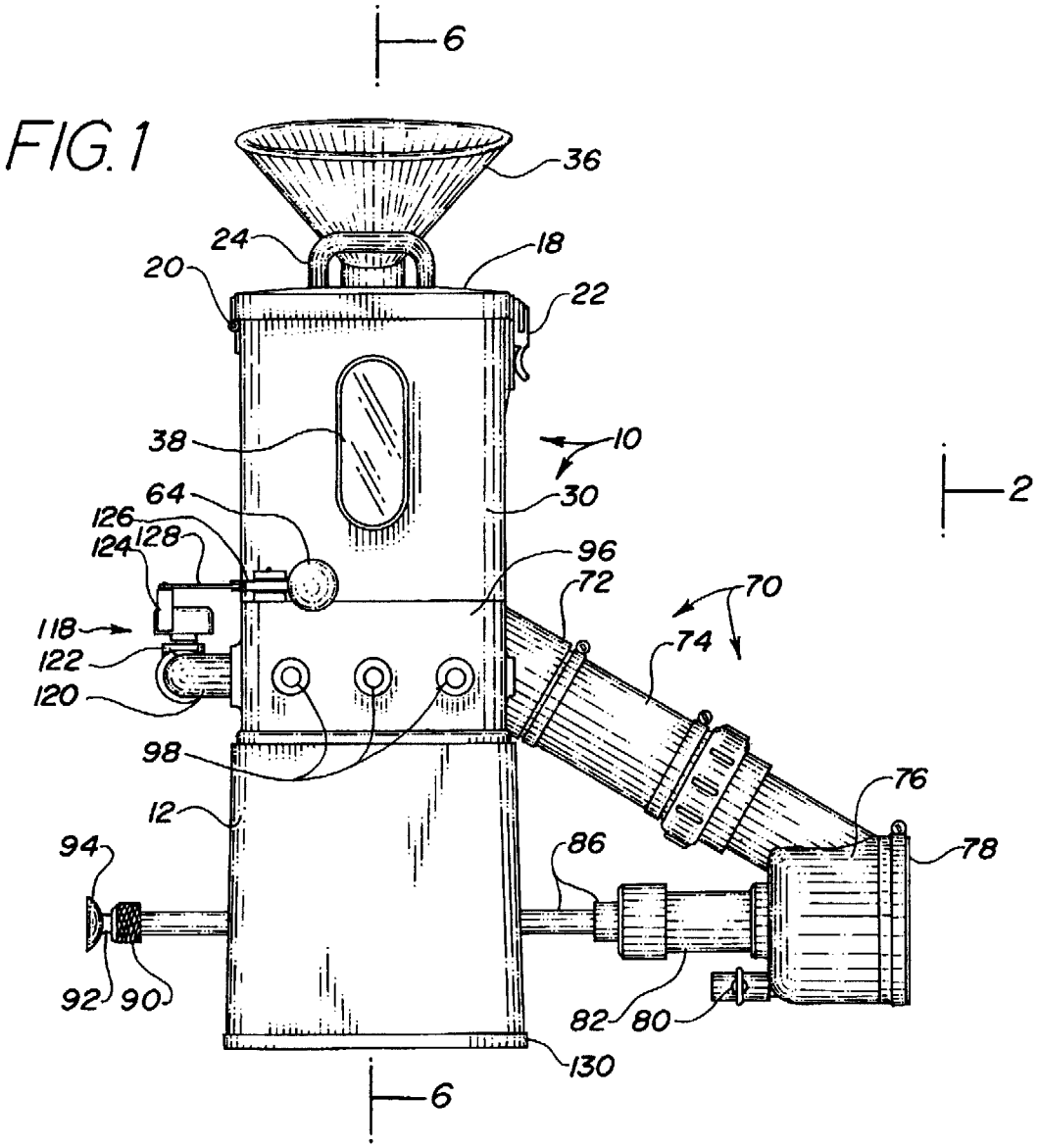
FIG. 1 is a front elevation view of the device of the present invention.
Figure 2:
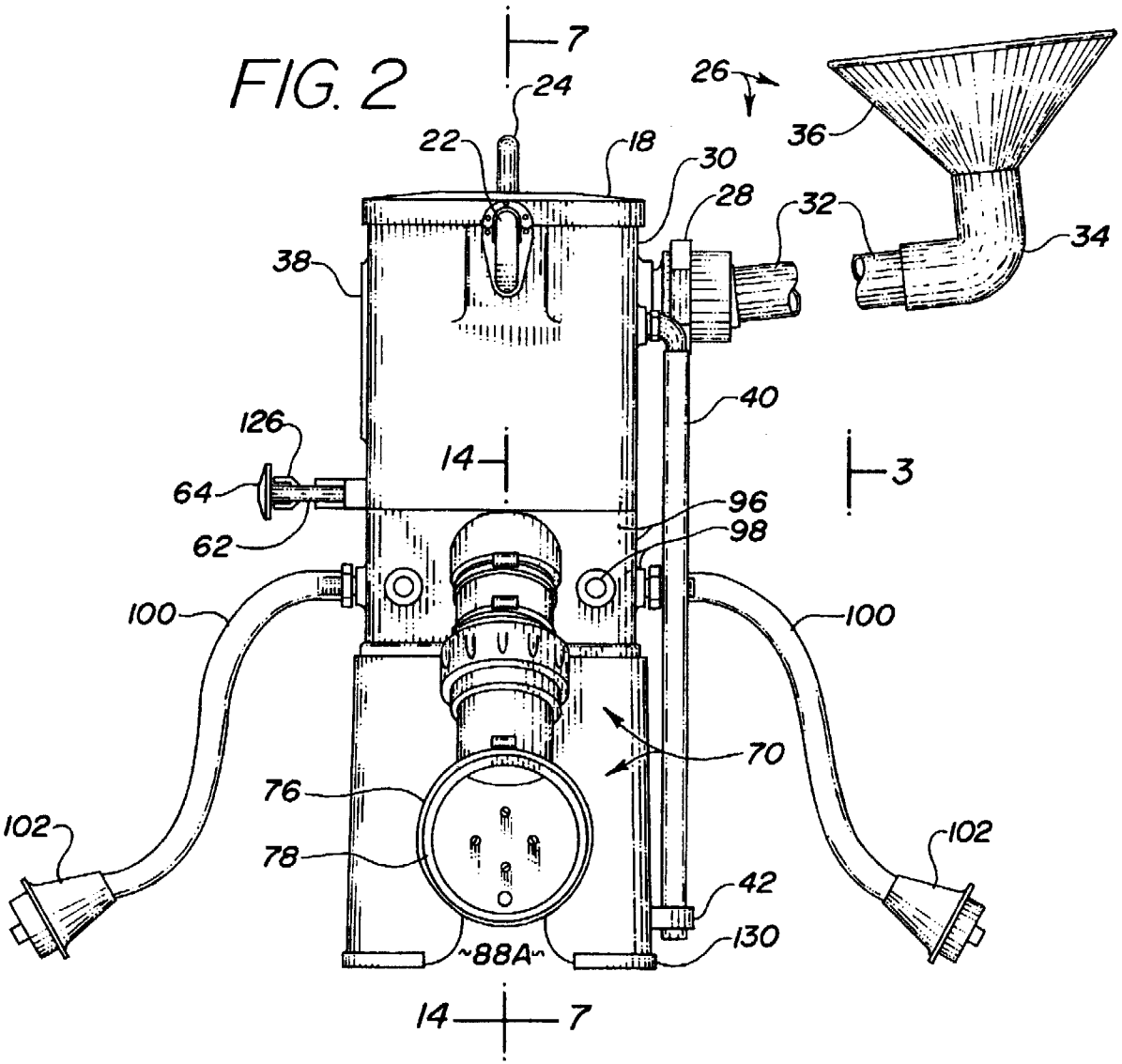
FIG. 2 is a right side elevation view of the device of the present invention.
Figure 3:
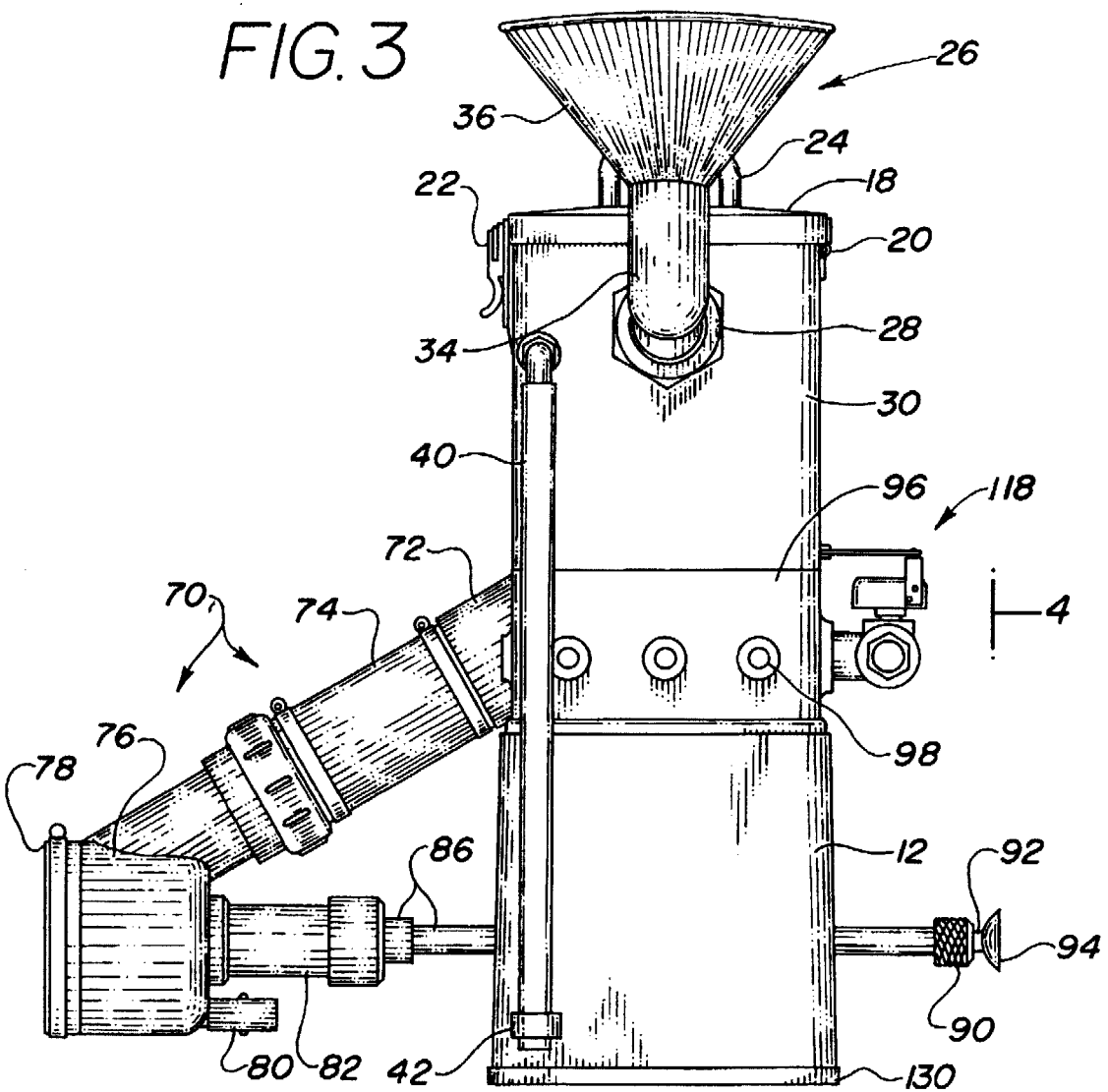
FIG. 3 is a rear elevation view of the device of the present invention.
Figure 4:
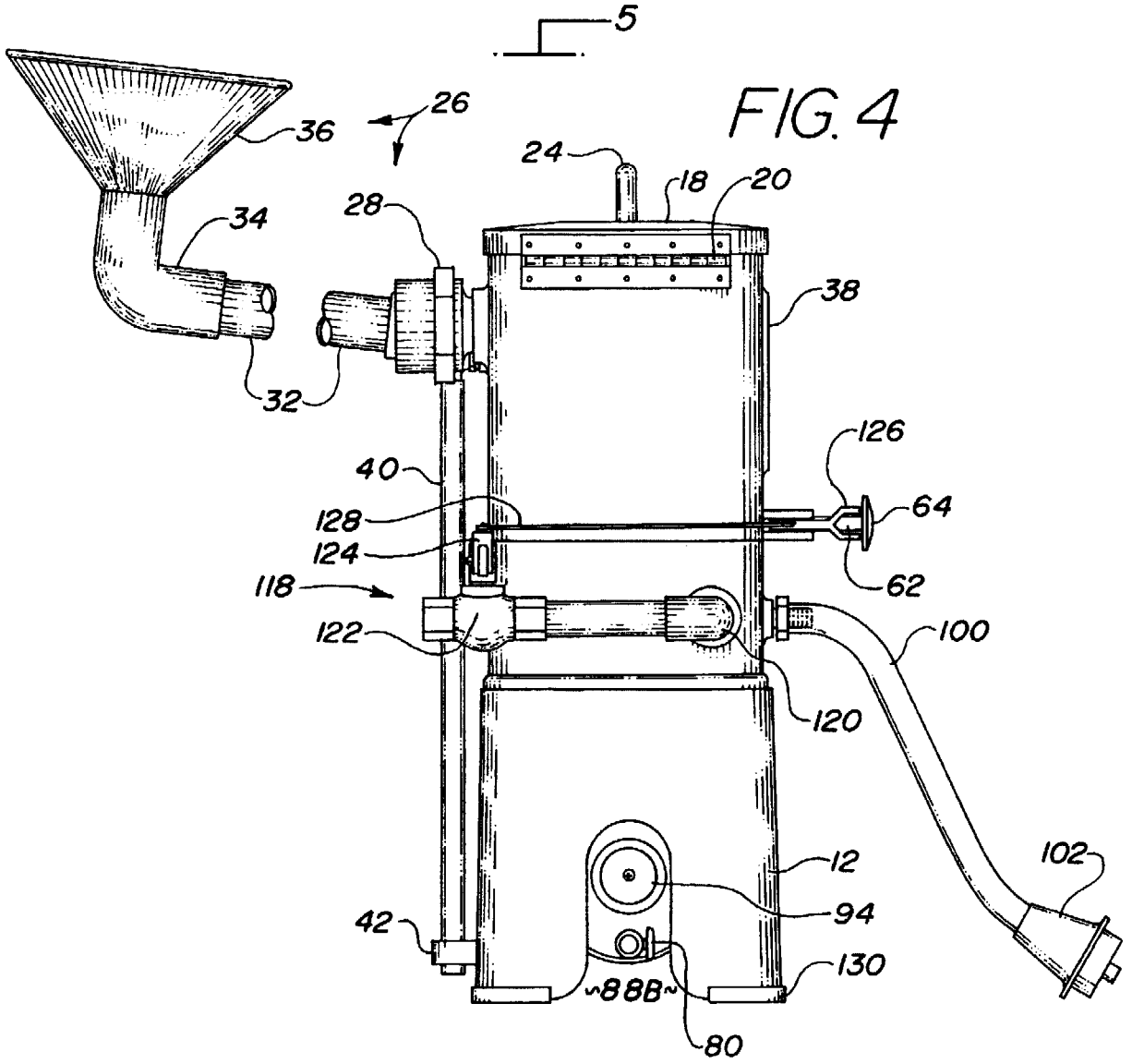
FIG. 4 is a left side elevation view of the device of the present invention.
Figure 5:
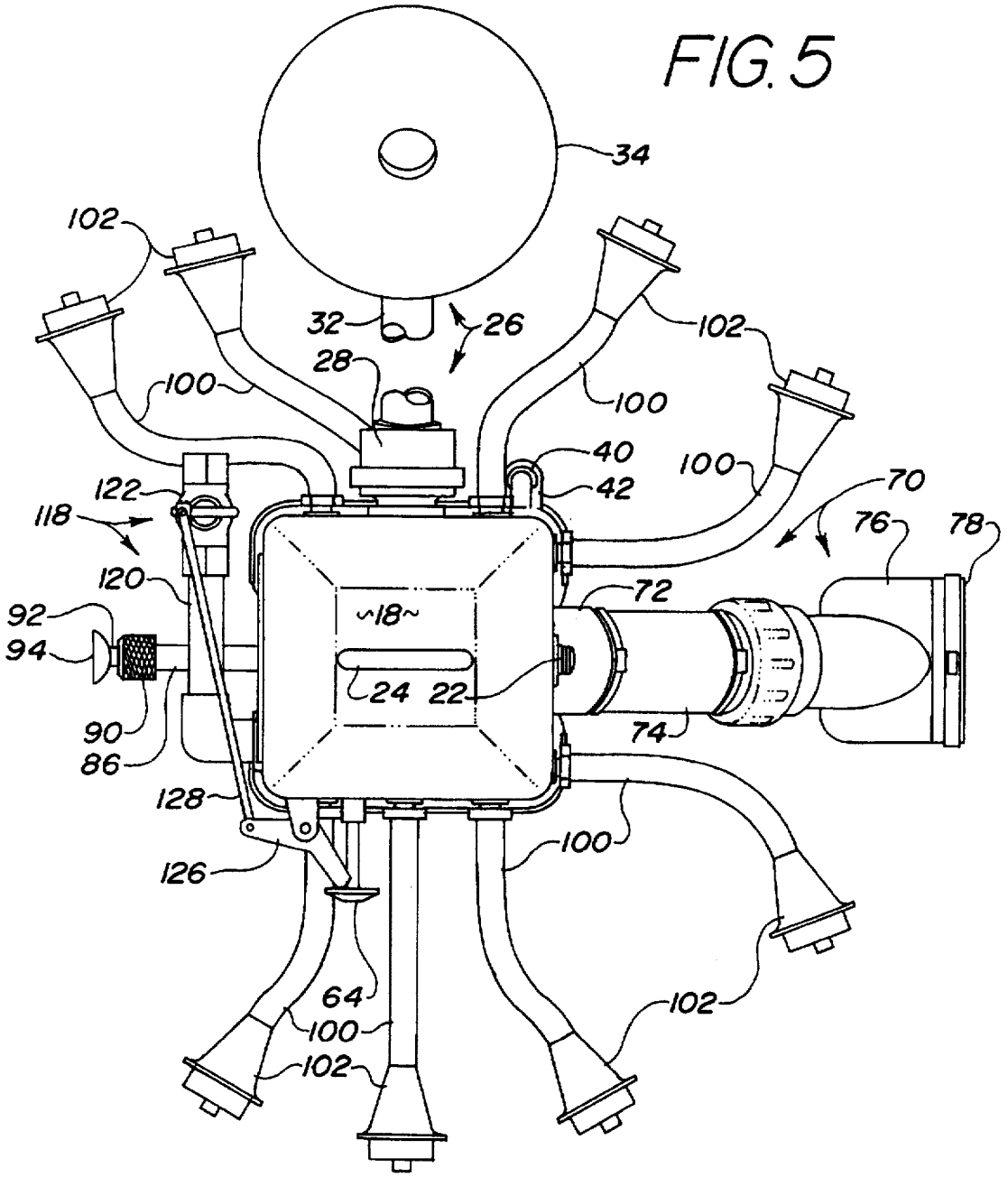
FIG. 5 is a top plan view of the device of the present invention.

The device of the present invention comprises a compartmentalized tank assembly 10. As seen in FIGS. 1–6, the tank assembly comprises a base 12, an intake chamber 14 and an outlet chamber 16.

The top of the device has a lid 18 for service access to the interior. The lid 18 is attached to the device by hinge means 20. A clasp/closure latch 22 is used to secure the lid 18 in a closed position while the unit is in operation. Attached to the lid 18 is a handle 24.

A fill assembly 26 is located on the upper portion of the outlet chamber 16. The fill assembly 26 comprises an adjustable angle ball union 28 that threadably protrudes through the sidewall 30 of the outlet chamber 16. A fill pipe 32 is affixed to the ball union 28. An elbow joint 34 attaches the fill pipe 32 to a funnel 36. The fill assembly 26 is used to facilitate introduction of appropriate cleaning solution during device initialization. The ball union 28 permits adjustment of the slope of the fill pipe 32.

A view window 38 located on the sidewall 30 of the outlet chamber 16 assures that the appropriate amount of solution is introduced.

Also protruding through the sidewall 30 of the outlet chamber 16, is an overflow pipe 40. The overflow pipe 40 is located just below the fill assembly 26. The overflow pipe 40 angles downwardly and is secured to the base 12 by a bracket 42.

Figure 6:
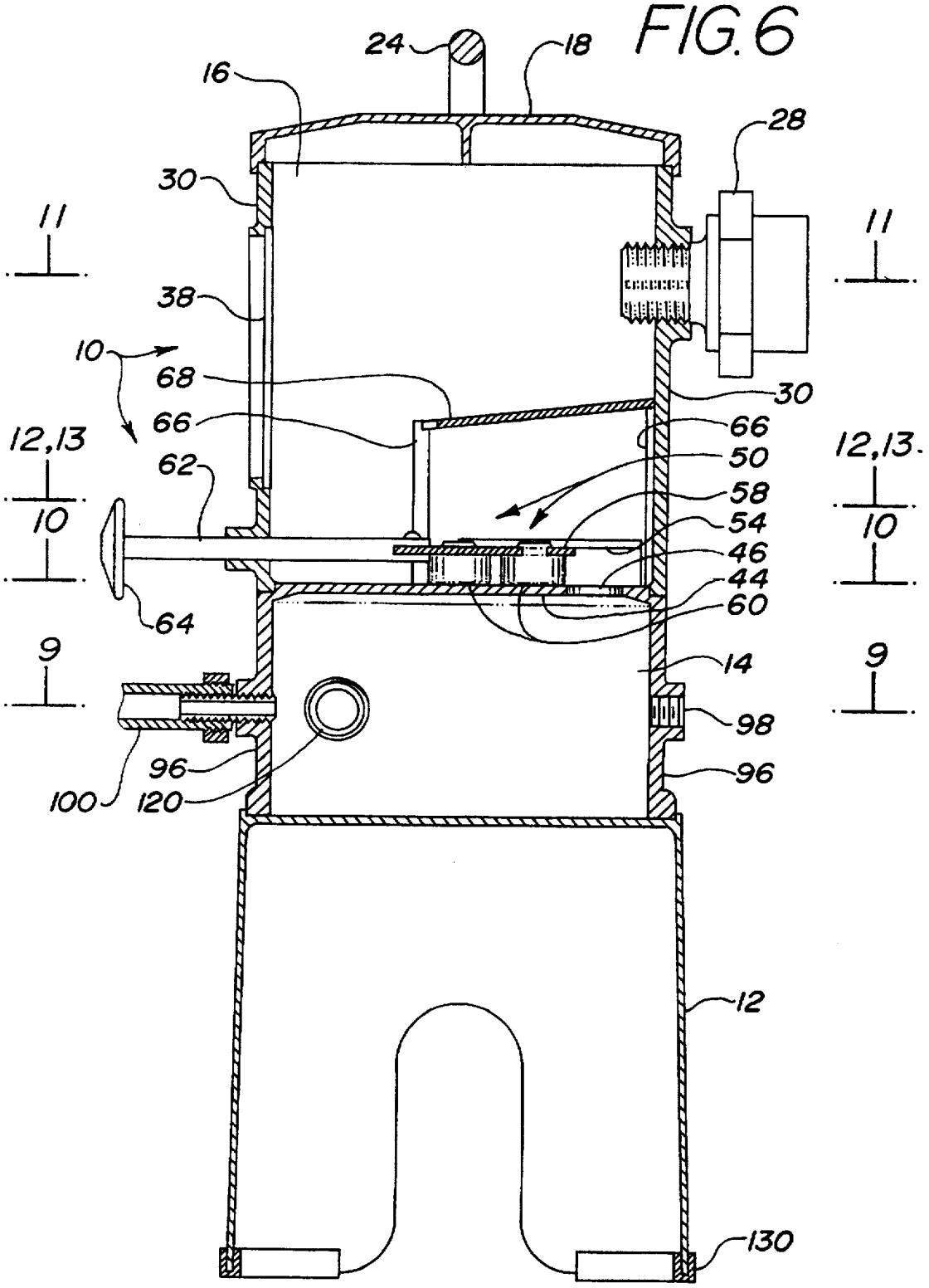
FIG. 6 is a vertical section view of FIG. 2.
Figure 7:
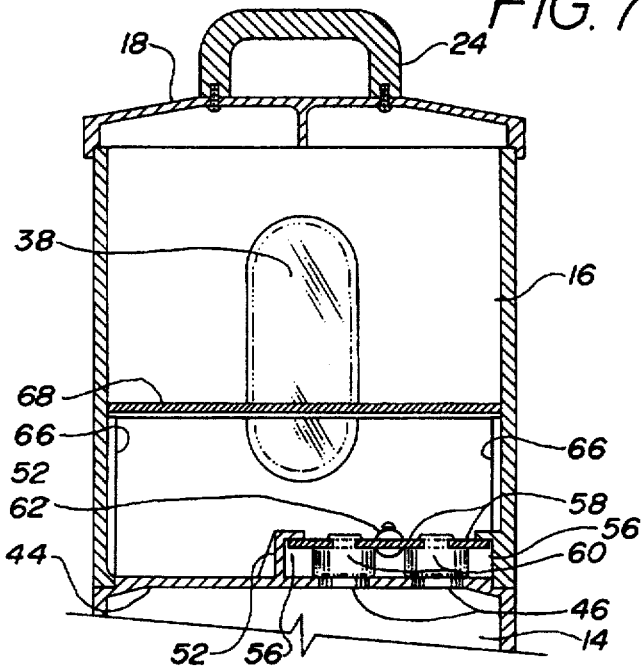
FIG. 7 is a vertical section view of FIG. 3.
Figure 8:
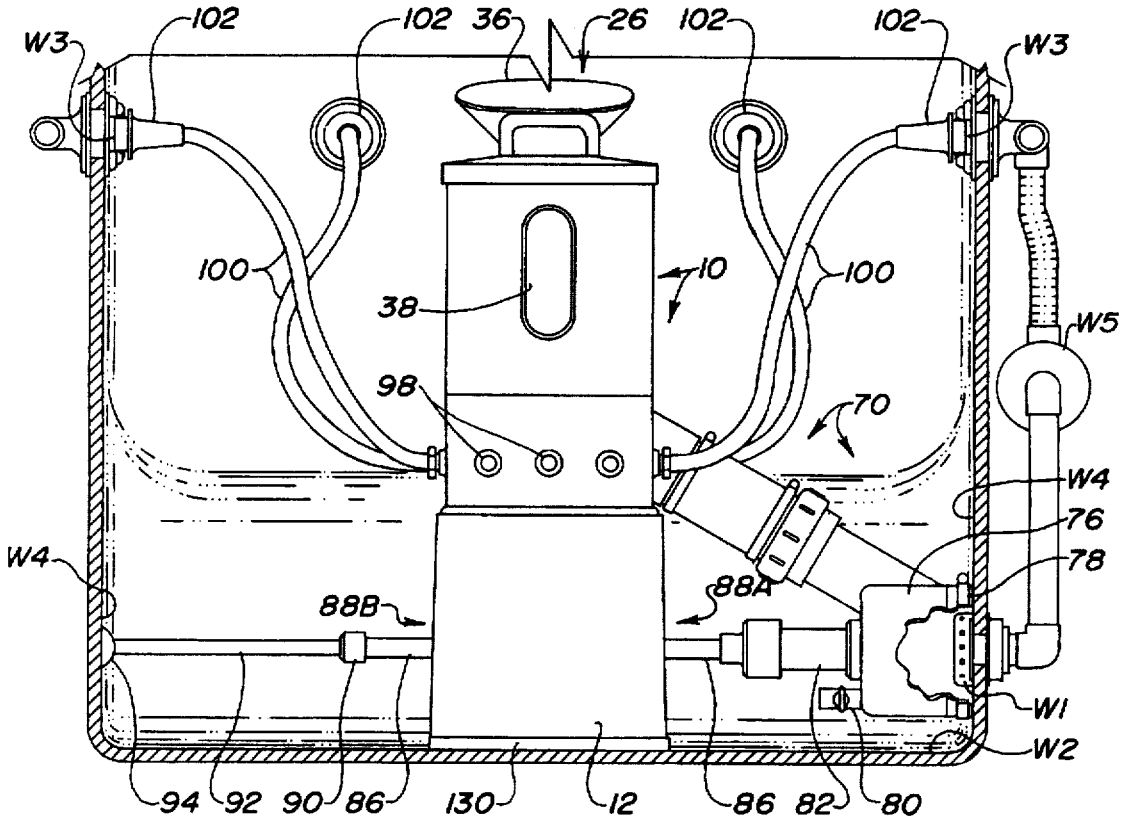
FIG. 8 is a view of the device installed within a whirlpool spa.
Figure 9:
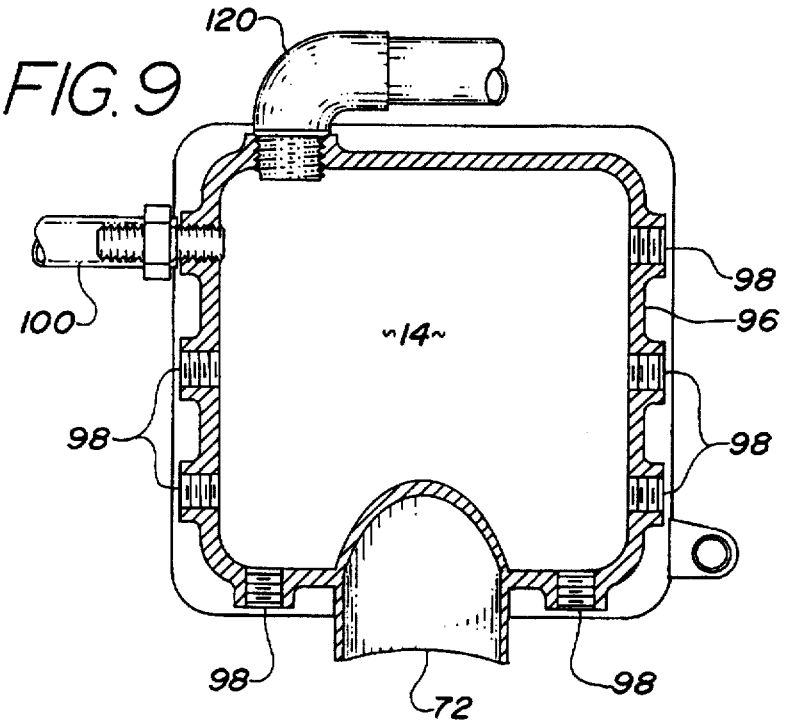
FIG. 9 is a horizontal section view of FIG. 2 taken at the intake openings.
Figure 10:
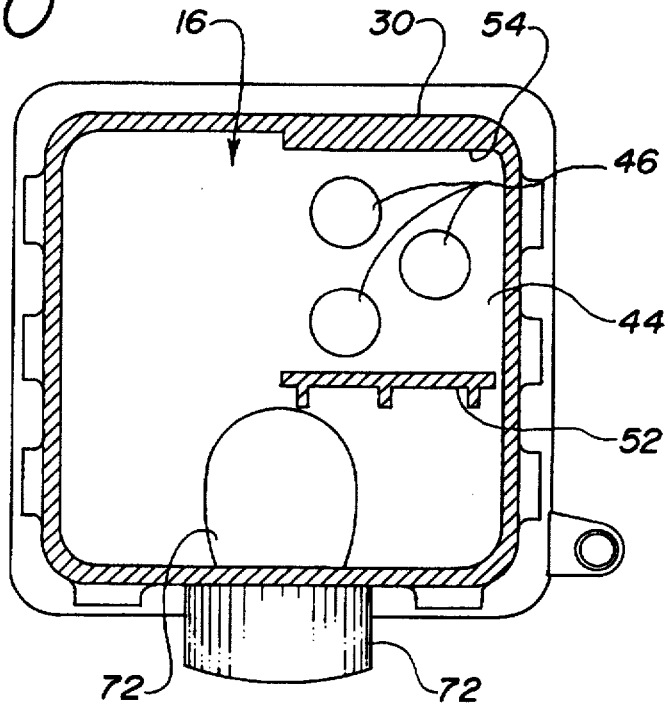
FIG. 10 is a horizontal section view from FIG. 2 taken above the intake openings.
Figure 11:
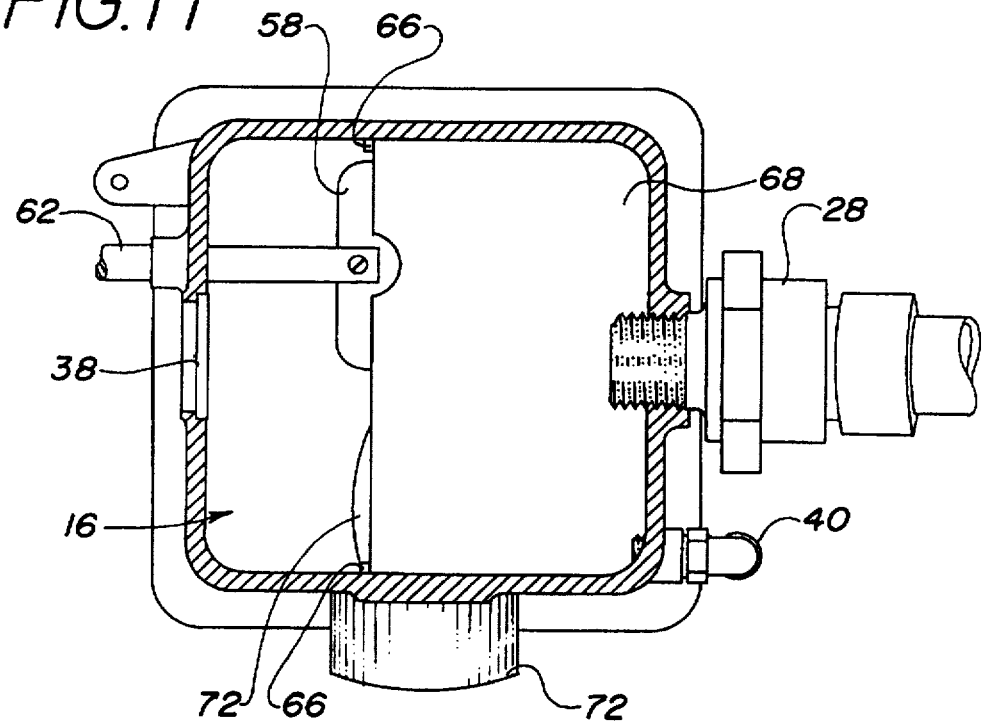
FIG. 11 is a horizontal section view from FIG. 2 taken above the fill assembly.
Figure 12:
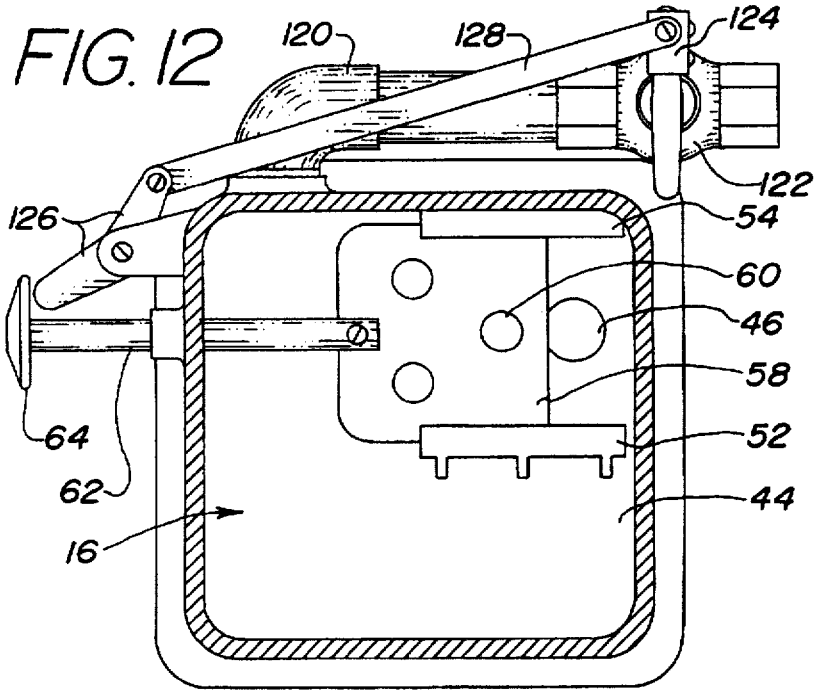
FIG. 12 is a horizontal section view from FIG. 2 showing the chamber regulator open and the drain assembly's drain valve closed.

As seen in FIG. 6, a chamber plate 44 separates the intake chamber 14 from the outlet chamber 16. As seen in FIG. 10, the chamber plate 44 has a plurality of inlet openings 46. The chamber plate 44 also has a discharge outlet 48.

A chamber regulator 50 controls the opening and closing of the inlet openings 46. The chamber regulator 50 comprises a first guide rail 52 formed onto the chamber plate 44, and a second corresponding guide rail 54 formed onto the outlet chamber sidewall 30. The two guide rails 52 and 54 have longitudinal grooves 56 that receive a regulator valve 58. A series of seals 60 is affixed to the bottom of the regulator valve 58. When the regulator valve 58 is in a fully extended (closed) position, the seals 60 correspond with the inlet openings 46 and thereby seal the inlet openings 46 preventing fluid flow between the intake chamber and the outlet chamber. When the regulator valve 58 is retracted (open position) the seals 60 are also retracted, thereby exposing the inlet openings 46.

A shaft 62 is affixed to the edge of the regulator valve 58. The shaft 62 protrudes through the outlet chamber sidewall 30 and terminates in a knob 64. It is expressly recognized that other valve assemblies can be utilized in order to open and close the inlet openings 46 of the chamber plate 44.

A series of supports 66 is formed into the inner sidewalls 30 of the outlet chamber 16. The supports 66 receive and support a diffusion plate 68.

A discharge assembly 70 extends downwardly from the chamber plate 44. The discharge assembly 70 comprises a drain pipe 72 that is affixed to the discharge outlet 48. The drain pipe 72 passes through the intake chamber 14 and terminates outside the device. A flexible hose 74 is attached to the drain pipe 72. The opposite end of the flexible hose 74 is attached to a pot portion 76. The pot portion 76 is designed to securely fit around a whirlpool suction intake fitting W1 located near the whirlpool floor W2. A gasket 78 encompassing the outer edge of the pot portion 76 helps assure a sealed fit. A drain valve 80 is located on the bottom of the pot portion 76.

Figure 14:
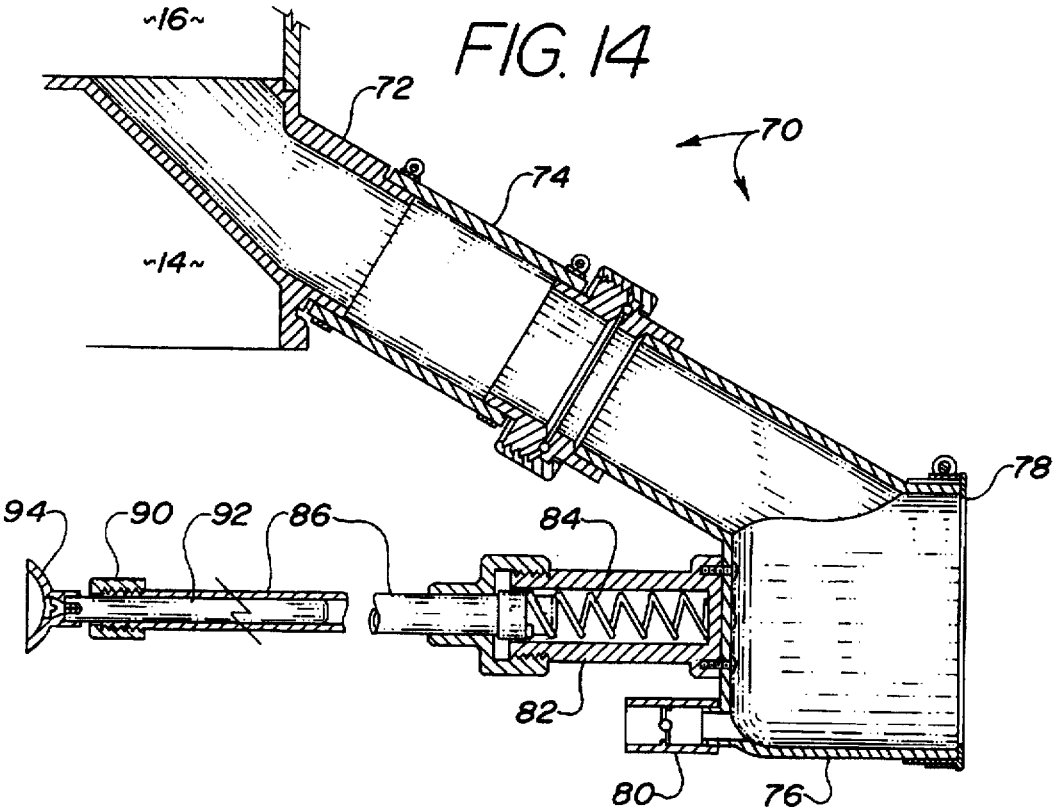
FIG. 14 is a vertical section view of the outlet assembly and the telescoping compression rod assembly.

As seen in FIG. 14, a compression rod assembly comprises a spring chamber 82 and a coil spring 84 located within the spring chamber 82. The coil spring 84 is biased against the back of the pot portion 76. The opposing end of the spring 84 is attached to a telescoping rod 92 slidably contained within a rod housing 86. The rod housing 86 passes through a pair of U-shaped slots 88*a* and 88*b* located on the base member 12. Located on the end of the rod housing 86 is a compression nut 90. The telescoping rod 92 extends outwardly from the rod housing 86 and is locked into place by the compression nut 90. A rubber stopper 94 is located on the end of the telescoping rod 92.

Protruding through the sidewalls 96 of the intake chamber 14 is a plurality of threaded intake openings 98. Each threaded intake opening 98 threadably receives an intake hose 100. Located on the end of each intake hose 100 is a plug assembly 102. Each plug assembly 102 is designed to friction fit or press fit into a whirlpool jet opening W3.

Figure 16:
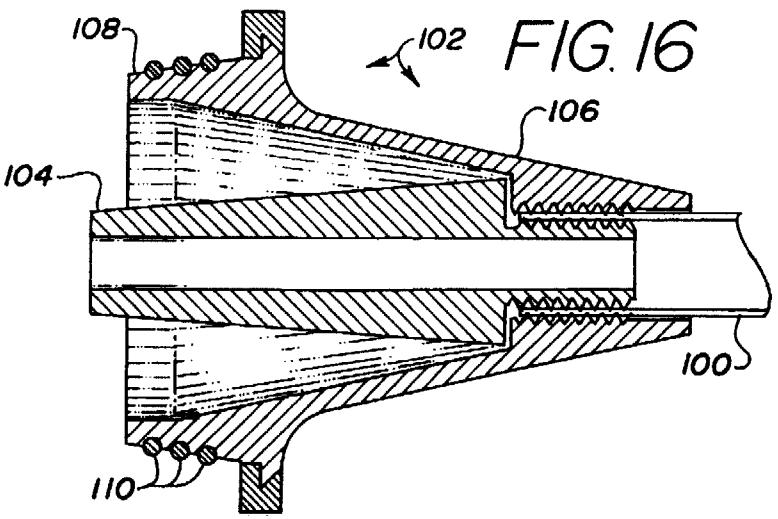
FIG. 16 is a sectioned side elevation view of FIG. 15.
Figure 18:
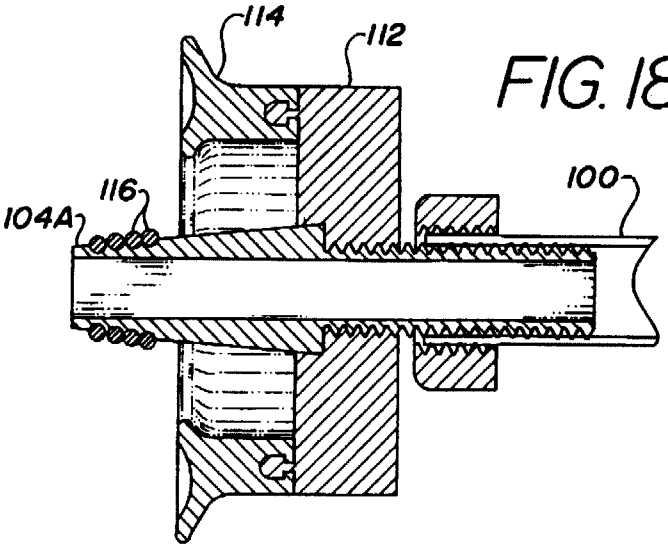
FIG. 18 is a sectioned side elevation view of FIG. 17.
Figure 15:
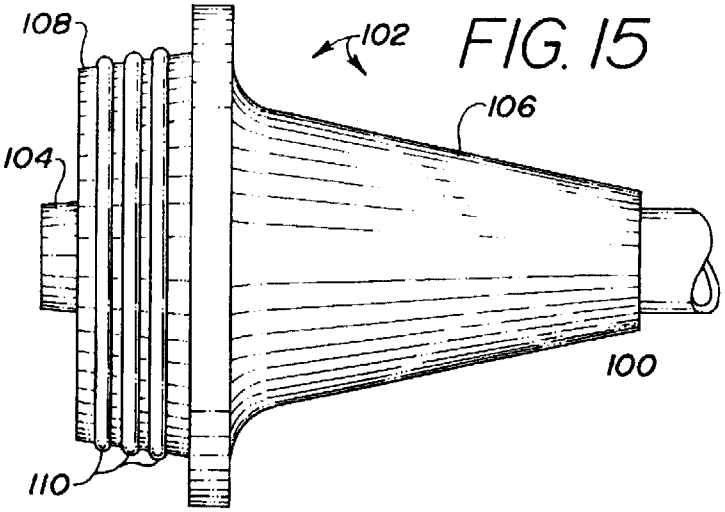
FIG. 15 is a side elevation view of the plug assembly.

As seen in FIGS. 15 and 16, the plug assembly 102 comprises a tapered jet insert 104 threadably attached to the intake hose 100. The jet insert 104 is encompassed by and protrudes from the end of a plug covering 106. The plug covering 106 has a annular gasket 108 and a tapered end that has a series of spaced-apart encompassing ribs 110. The plug assembly 102 is inserted into the jet opening W3 establishing fluid communication between the jet and the intake hose 100. When the plug assembly 102 is inserted into the jet opening W3, the ribs 110 engage the walls of the jet opening preventing the plug assembly 102 from being forced out of the jet opening W3 when the device is operational.

Figure 17:
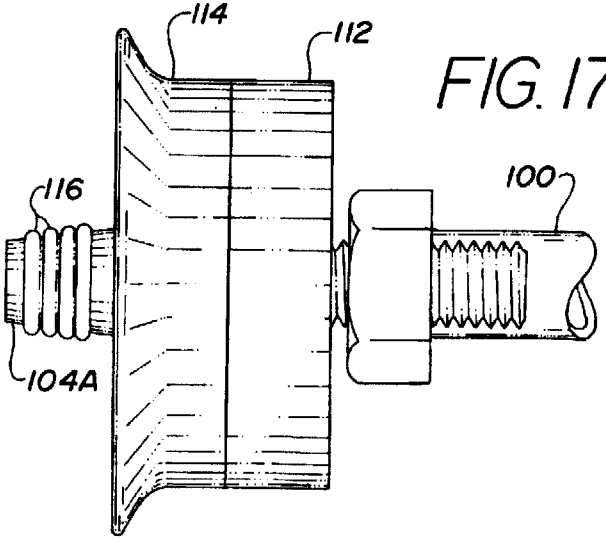
FIG. 17 is a side elevation view of a second embodiment of the plug assembly.

As seen in FIG. 17 an 18, an alternate embodiment of the plug assembly 102 is disclosed. As seen, the plug assembly 102 has a tapered jet insert 104. The jet insert 104 is encompassed by a plug covering 112. The plug covering 112 has a relatively flat cylindrical shape and has a flanged gasket 114. The end of the jet insert 104 protrudes from the flanged end 114 of the plug covering 112 and has a series of encompassing spaced apart ribs 116 located thereon. When inserted into a whirlpool jet opening W3, the flanged end 114 engages the walls of the jet opening W3 preventing the plug assembly 102 from being forced out of the jet opening W3 when the device is operational. The ribs 116 of the jet insert 104 engage the walls of the jet itself, thereby further aiding in preventing the plug assembly 102 from being forced out of the jet opening W3 when the device is operational.

To further assist in preventing the plug assembly 102 from being forced out of the jet opening W3 when the device is operational, an optional retention means (not shown) can be used in conjunction with the plug assembly. Such retention means can include the use of compression rod means affixed to the back of the plug assembly with the opposing end of the compression rod means affixed to an opposing wall of the whirlpool spa or being pivoted downward and affixed to the floor of the spa. Other retention means can also be used.

Also located on the intake chamber 14 is a drain assembly 118. The drain assembly 118 comprises a drain pipe 120 that protrudes into the interior of the intake chamber 14. Located on the distal end of the drain pipe 120 is a drain valve 122. A valve control lever 124 opens and closes the drain valve 122.

Figure 13:
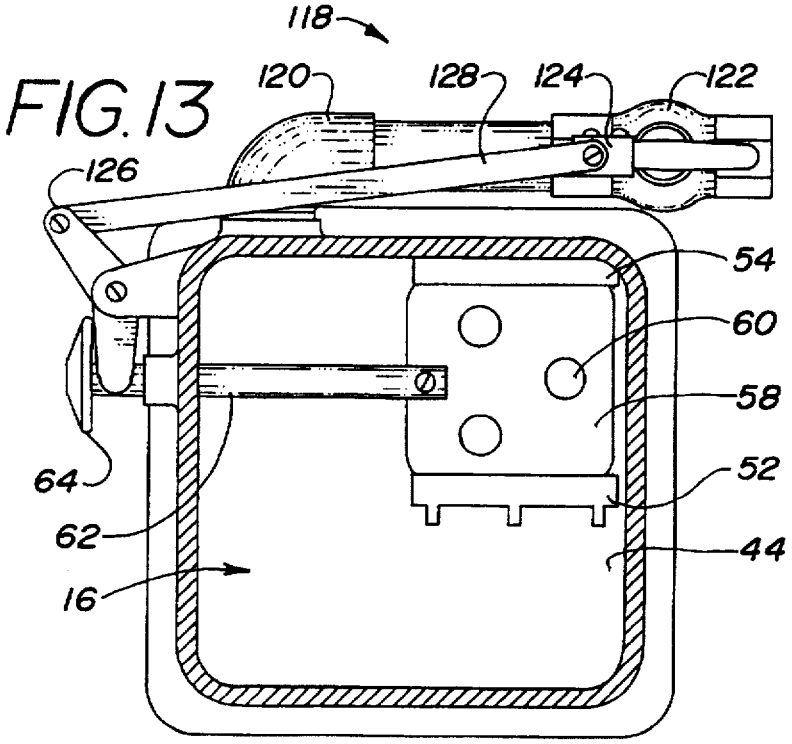
FIG. 13 is a horizontal section view from FIG. 2 showing the chamber regulator closed and the drain assembly's drain valve open.

As seen in FIGS. 13 and 14, the shaft 62 of the regulator valve 58 controls the operation of the drain assembly's drain valve 122. One end of a bellcrank 126 is attached to the shaft 62 while the opposing end of the bellcrank 126 is attached to a link member 128. The link member 128 is attached to the valve control lever 124. When the chamber regulator 50 is open (shaft 62 extended outwardly from the device thereby causing the valve cover plate 58 and associated seals 60 to expose the inlet openings 46), the valve control lever 124 and the drain valve 122 are closed. In order to close the chamber regulator 50, the shaft 62 is depressed inward. As the shaft 62 is depressed inward, the bellcrank 126 is also depressed causing the opposing end of the bellcrank 126 to be thrust outwardly thereby engaging the link member 128. In turn, the link member 128 causes the valve control lever 124 to rotate, thereby opening the drain valve 122. It should be noted that pulling the shaft 62 outwardly (and thereby opening the chamber regulator 50) will not cause to the drain valve 122 to close. This closing must be performed as a separate act. This permits the chamber regulator 50 and the drain valve 122 to be open simultaneously. However, it is impossible to have both valves closed simultaneously.

In order to utilize the whirlpool spa cleaner of the present invention, the device is placed onto the floor of a whirlpool spa W2. A non-scuff portion 130 on the bottom of the base 12 assures that the device does not scratch or otherwise damage the spa's surface. The pot portion 76 is positioned so that it fits and seals around a whirlpool suction intake fitting W1. The flexible hose 74 of the outlet assembly 70 permits for variations in location of the intake fitting W1. The pot portion 76 can be raised as needed. The U-shaped slots 88*a* and 88*b* of the base member 12 are of sufficient height to permit the compression rod assembly to be raised in tandem with the pot portion 76.

The telescoping rod 92 is extended until the rubber stopper 94 abuts against the wall of the whirlpool. The compression nut 90 is tightened in order to hold the telescoping rod 92 in its extended position. The coil spring 84, being slightly depressed, biases the telescoping rod 92 and the pot portion 76 in place against opposing walls W4 of the whirlpool.

Once the device is fitted into place, the fill assembly 26 is adjusted so that the fill pipe 32 slopes downwardly from the funnel 36 into the outlet chamber 16. This downward slope is especially critical when the floor W2 of the whirlpool spa is not level.

A plug assembly 102 is fitted into a whirlpool jet opening W3. The intake hose 100 attached to the plug assembly 102 is affixed to an intake opening 98 on the intake chamber 14. One plug assembly 102, with accompanying intake hose 100, is fitted into each jet opening W3. If there are fewer jet openings W3 than intake openings 98, the unused intake openings 98 are simply plugged with a stopper (not shown).

The shaft 62 is extended outwardly so as to open the chamber regulator 58. The drain assembly's drain valve 122 and pot portion's drain valve 80 are each closed. Appropriate cleaning solution is introduced into the device via the fill assembly 26. The initial fluid will flow out of the outlet assembly 70 and will backup into the flexible hose 74 and pot portion 76.

The whirlpool is switched on. The fluid in the device will be sucked out of the pot portion 76 and will be pumped through the whirlpool's pump system W5. The fluid will then be expelled out through the jet openings W3. The fluid will enter each plug assembly 102 attached to each of the jet openings W3. The fluid will be routed through the intake hoses 100 and through the intake openings 98 into the intake chamber 14. From there, the fluid, by being pressurized, is thrust up through the inlet openings 46 into the outlet chamber 16. The thrusting fluid hits the diffusion plate 68, reducing outlet chamber 16 turbulence. From there, the fluid drains out through the outlet assembly 70 and begins the cycle again.

After the whirlpool is on for a few seconds, the fluid flow reaches equilibrium. Additional fluid is introduced into the outlet chamber 16 so that there is a constant reservoir of fluid within the outlet chamber 16. Fluid levels can be verified through the view window 38. Excess fluid will be drained out of the device through the overflow pipe 40. A pan can be placed at the base of the overflow pipe 40 in order to capture the excess fluid.

Once the fluid has cycled through the whirlpool system a sufficient amount of time, the shaft 62 is depressed inwardly, causing the chamber regulator 50 to close and the drain assembly's drain valve 122 to open. As the pressurized fluid can no longer enter the outlet chamber 16, it is forced into the drain assembly 118 and is discharged out of the device. A bucket or other similar vessel can be used to capture the discharged fluid. The pot portion's drain valve 80 is opened in order to drain any remaining fluid from the outlet chamber 16 and outlet assembly 70.

The device can be refilled with water and the system can be reinitiated in order to rinse the whirlpool of cleaning solution residue. Thereafter, the device is detached from the whirlpool. The compression nut 90 is loosened and the telescoping rod 92 is withdrawn from the sidewall of the whirlpool spa. Each plug assembly 102 is removed from each of the jet openings W3 and the device is removed.

While the invention has been particularly shown and described with reference to an embodiment thereof, it will be understood by those skilled in the art that various changes in form and detail may be made without departing from the spirit and scope of the invention.

I claim:

1. A spa cleaning device comprising:

a) a fluid holding tank having an intake chamber and an outlet chamber, the intake chamber being in fluid communication with the outlet chamber, the intake chamber being in fluid communication with the jet openings of the spa, and the outlet chamber being in fluid communication with the suction intake fitting of the spa;

b) a valve means for controlling the fluid communication between the intake chamber and the outlet chamber;

c) a drain means located within the intake chamber for draining the intake chamber; and d) control means for simultaneously controlling the valve means and the drain means such that the valve means and drain means are not closed simultaneously.

2. The device of claim 1 to further include a fill assembly attached to the outlet chamber for permitting fluid entry into the outlet chamber.

3. The device as in claim 1 to further include an overflow pipe attached to the outlet chamber for routing excess fluid out of the device.

4. A spa cleaning device comprising:

a) a fluid holding tank having an intake chamber and an outlet chamber, the intake chamber being in fluid communication with the outlet chamber;

b) a pot portion, having a first drain means, adapted to fit over a suction inlet of a spa;

c) a drain assembly means for placing the outlet chamber in fluid communication with the pot portion;

d) a plurality of hoses each having one end attached to the intake chamber and each opposing end adapted to attach to a whirlpool jet opening;

e) a valve means for controlling the fluid communication between the intake chamber and the outlet chamber;

f) a second drain means in fluid communication with the intake chamber for draining the intake chamber; and g) a control means for simultaneously controlling the valve means and the second drain means such that the valve means and second drain means are not closed simultaneously.

5. The device of claim 4 to further include a fill assembly in fluid communication with the outlet chamber comprising:

a) a ball union connected to and in fluid communication with the outlet chamber;

b) a fill pipe, having one end connected to the ball union and its opposing end being elbow joined to a funnel.

6. The device as in claim 4 to further include:

a) a lid, hingedly attached to the outlet chamber and having a latch for securing the lid to the outlet chamber;

b) a view window on the side of the outlet chamber; and c) a base, attached to the bottom of the intake chamber, having a pair of U-shaped opposing openings and a non-scuff bottom.

7. The device as in claim 4 wherein the control means comprises:

a) a shaft, having a knob on one end and its opposing end attached to the valve means;

b) a bellcrank, attached to the intake chamber, having a first arm and a second arm; and c) a link member having one end attached to the second arm of the bell crank and its opposing end attached to the second drain means such that when the shaft is depressed the shaft engages the first arm of the bell crank thereby rotating the bellcrank so that the second arm of the bell crank moves the link member which in turns opens the second drain means thereby permitting draining of the intake chamber.

8. The device as in claim 4 to further include an overflow pipe attached to the outlet chamber for routing excess fluid out of the device.

9. The device as in claim 4 to further include a compression rod means having one end attached to the pot portion and its opposing end removably fixed to the spa wall for securely holding the pot portion against the suction intake.

10. The device as in claim 9 wherein the compression rod means comprises:

a) a spring chamber attached to the pot portion;

b) a spring mounted within the spring chamber;

c) a rod housing;

d) a telescoping rod, slidably engaged within the rod housing, having a rubber stopper on one end and having its opposing end attached to the spring; and e) a nut means, threadably attached to the rod housing, for securing the telescoping rod within the rod housing.

11. The device as in claim 4 wherein the drain assembly means comprises a flexible house having one end attached to the outlet chamber and its opposing end attached to the pot portion.

* * * * *